US005607327A

United States Patent [19]

Tsuji et al.

[11] Patent Number: 5,607,327

[45] Date of Patent: Mar. 4, 1997

[54] DOUBLE LOCKING CONNECTOR

[75] Inventors: Masanori Tsuji; Keishi Jinno, both of Shizuoka, Japan

[73] Assignee: Yazaki Corporation, Tokyo, Japan

[21] Appl. No.: 353,976

[22] Filed: Dec. 6, 1994

[30] Foreign Application Priority Data

Dec. 6, 1993 [JP] Japan ..... 5-065036 U

[51] Int. Cl.[6] ..... H01R 13/514

[52] U.S. Cl. ..... 439/752; 439/595

[58] Field of Search ..... 439/595, 752, 439/600, 352

[56] References Cited

U.S. PATENT DOCUMENTS

| | | | |
|---|---|---|---|
| 4,975,082 | 12/1990 | Nagasaka et al. . | |
| 5,181,862 | 1/1993 | Hawk et al. | 439/752 |
| 5,346,414 | 9/1994 | Sakai et al. | 439/752 |
| 5,435,758 | 7/1995 | Sasai et al. | 439/752 |
| 5,439,397 | 8/1995 | Yamanashi et al. | 439/752 |
| 5,458,511 | 11/1995 | Sasai et al. | 439/752 |
| 5,484,223 | 1/1996 | Saito | 439/752 |
| 5,501,620 | 3/1996 | Ishii et al. | 439/752 |

FOREIGN PATENT DOCUMENTS

| | | | |
|---|---|---|---|
| 319180 | 4/1991 | Japan | H01R 13/42 |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A double-locking connector including a front holder for double locking terminals within a connector housing where the terminals can be removed from the housing without disengaging the front holder from the housing. The double-locking connector includes a connector housing including terminal accommodating chambers which have stoppers against which metal terminals abut when they are inserted into the terminal accommodating chambers from the rear, and flexible locking pieces adapted to lock the metal terminals in the terminal accommodating chambers, respectively. The connector also includes a front holder which is engageable with the connector housing from the front. The front holder has flexible locking pieces which are respectively engageable with the metal terminals. Each of the flexible locking pieces has temporary locking protrusions and final locking protrusions which are engaged with locking portions forming the front end of the respective terminal accommodating chamber. When the front holder is in a temporarily locked position, the flexible locking pieces are not engaged with the metal terminals; when the front holder is in a completely locked position the flexible locking pieces are engaged with the metal terminals; and when the front holder is thereafter moved in a perpendicular direction the final locking protrusions become disengaged with the metal terminals.

14 Claims, 7 Drawing Sheets

DOUBLE LOCKING CONNECTOR

BACKGROUND OF THE INVENTION

1. Field of the Invention

This invention relates to a double locking connector with a front holder which is used to connect, for instance, wire harnesses in an automobile.

2. Background

A conventional locking connector of this type is disclosed in Japanese Utility Patent Publication No. 19180/1991 and illustrated in FIGS. 11 and 12. The connector includes a connector housing a and a front holder f which is engageable with the housing a. The connector housing a has terminal accommodating chambers b in which flexible locking pieces d and stoppers e are provided for retaining metal terminals c in the chambers. The front holder f has double-locking flexible locking pieces g which are engageable with the metal terminals c, and terminal inserting holes h into which the terminals of the mating connector are inserted.

As shown in FIG. 12, the metal terminals c are inserted into the terminal accommodating chambers b of the connector housing a from the rearward end until the flexible locking pieces d are engaged with locking holes $c_1$ formed in the metal terminals, respectively. In this manner the metal terminals are primarily locked in the connector housing.

Under this condition, the front holder f is engaged with the forward end of the connector housing a so that the double-locking flexible locking pieces g engage with locking holes $c_2$ formed in the metal terminals. Thus, the metal terminals are secondarily locked. Hence, the metal terminals are positively prevented from disengaging from the connector housing.

When, on the other hand, it is desirable to remove the metal terminals from the connector housing a, it is necessary to disengage the flexible locking pieces d and g from the metal terminals c. The removal of the metal terminals is, in general, carried out by inserting a jig into the connector housing a from the forward end of the housing. However, with the conventional double locking connector described above, the insertion of the jig into the connector housing is not permitted, because the front surface of the connector housing is covered with the front holder f.

SUMMARY OF THE INVENTION

In view of the foregoing, an object of the invention is to provide a double locking connector having a front holder from which the metal terminals can be removed with ease.

The foregoing object of the invention has been achieved by the provision of a double-locking connector which, according to the invention, comprises:

a connector housing including terminal accommodating chambers which have stoppers for stopping metal terminals which are inserted into the terminal accommodating chambers from the rear, and flexible locking pieces adapted to lock the metal terminals to prevent the metal terminals from disengaging from the terminal accommodating chambers, respectively; and a front holder which is engageable with the connector housing from a forward end thereof, the front holder having double-locking flexible locking pieces which are engageable with the metal terminals, respectively, each of the double-locking flexible locking pieces having temporary locking protrusions and final locking protrusions which are engageable with locking portions forming the forward end of the respective terminal accommodating chamber, and wherein when the front holder is temporarily locked to the connector housing, the double-locking flexible locking pieces are set at non-engagement positions where the double-locking flexible locking pieces are not engaged with the metal terminals, when the front holder is completely locked to the connector housing, the double-locking flexible locking pieces are set at engagement positions where the double-locking flexible locking pieces are engaged with the metal terminals, and when the front holder thus completely locked is moved in a direction perpendicular to the direction in which the front holder is moved into or out of engagement with the connector housing, the final locking protrusions are moved to positions where the final locking protrusions are not engaged with the metal terminals.

In the double-locking connector, each of the double-locking flexible locking pieces includes a locking protrusion having a tapered abutting surface which is abutted against the front end portion of the metal terminal.

Furthermore in the double-locking connector, the front holder includes a plate-shaped holder body having jig penetration holes, and when the front holder is moved in a direction perpendicular to a direction in which the front holder is moved into or out of engagement with the connector housing, to a non-engagement position, the jig penetration holes are communicated with jig inserting holes formed in the connector housing.

In operation, the front holder is temporarily locked to the connector housing by engaging the temporary locking protrusions of the double-locking flexible locking pieces with the locking portions of the connector housing. Under this condition, the metal terminals are inserted into the connector housing from the rear until they are primarily locked by the flexible locking pieces. Thereafter, the front holder is pushed against the connector housing so that the final locking protrusions of the double-locking flexible locking pieces are engaged with the locking portions of the connector housing while the metal terminals are secondarily locked with the double-locking flexible locking pieces. When the final locking protrusions of the double-locking flexible locking pieces are engaged with the locking portions of the connector housing in the above-described manner, the locking protrusions of the double-locking flexible locking pieces abut against the front end portions of the metal terminals, and are moved while being flexibly displaced with the aid of the tapered abutting surfaces, thus being engaged with the metal terminals. In the case where any one of the metal terminals is not in position in the respective terminal accommodating chamber, the respective engaging protrusion is not displaced, thus pushing back the metal terminal.

To remove the metal terminals, the front holder which has been completely locked, is moved in the direction perpendicular to the direction in which the front holder is moved into or out of engagement with the connector housing, so as to disengage the double-locking flexible locking pieces from the metal terminals. Under this condition, the jig is inserted into the jig inserting hole through the jig penetration hole of the front holder, so as to remove the metal terminal from the connector housing while causing the flexible locking piece to disengage from the metal terminal.

DETAILED DESCRIPTION OF THE PREFERRED EMBODIMENTS OF THE INVENTION

Figure 1:
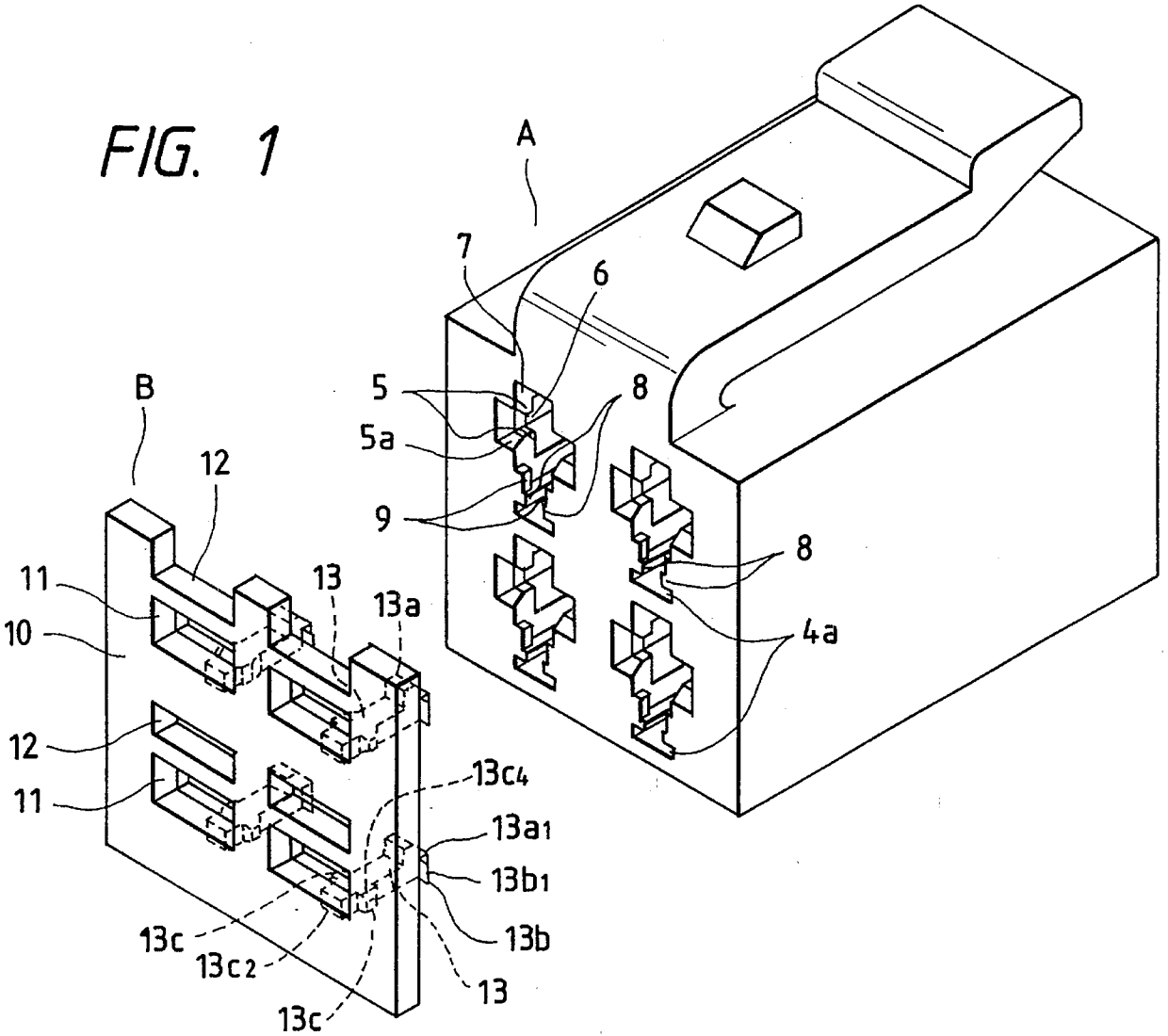
FIG. 1 is an exploded perspective view showing a double locking connector, which constitutes a first embodiment of the invention.
Figure 2:
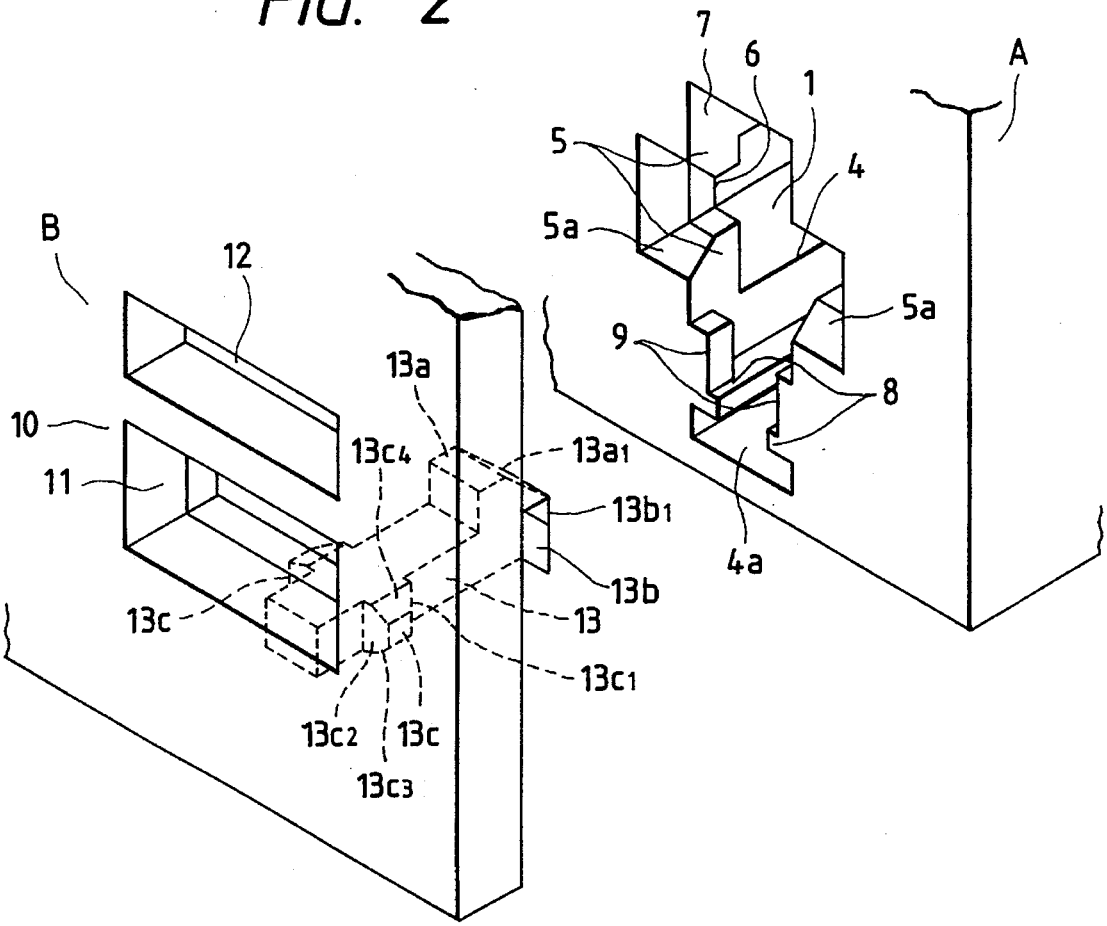
FIG. 2 is an enlarged perspective view of a part of the double locking connector shown in FIG. 1.
Figure 3:
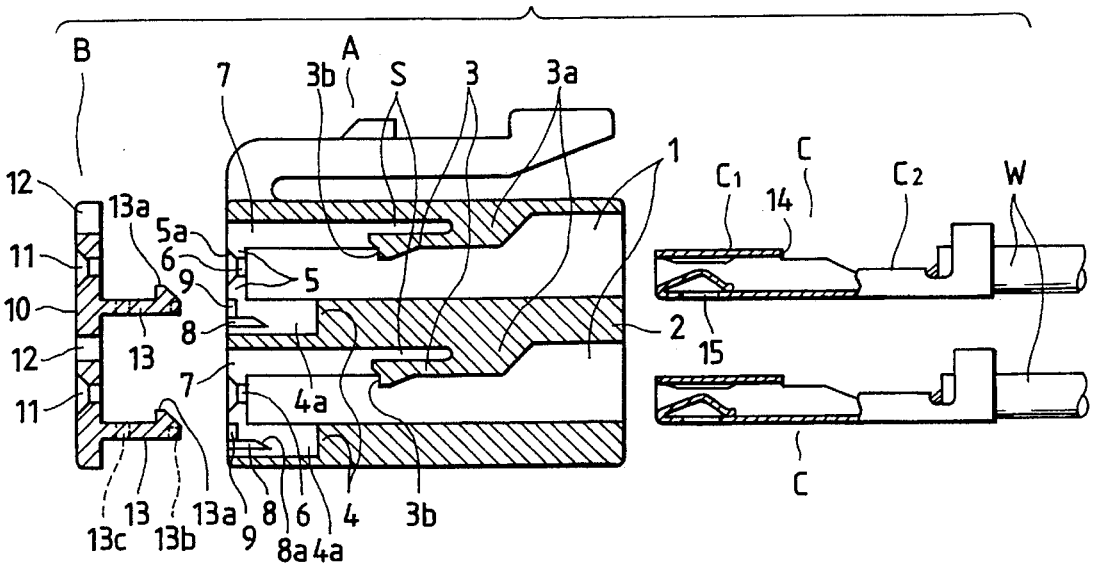
FIG. 3 is a sectional view showing a connector housing and a front holder and metal terminals which are removed from the connector housing.

FIGS. 1 through 3 show a double locking connector, which constitutes a first embodiment of the invention. In FIGS. 1 through 3, reference character A designates a connector housing made of synthetic resin; B a front holder made of synthetic resin; and C female metal terminals.

The connector housing A has a plurality of terminal accommodating chambers 1 which extend through the connector housing A in a front-to-rear direction. Each of the terminal accommodating chambers 1 includes a flexible locking piece 3 including a base portion 3*a* formed on the upper wall 2. The locking pieces each extends toward the forward end of the housing. Thus, a space S is formed between the flexible locking piece 3 and the upper wall 2 to allow the locking piece to be deflected upwardly. The free end portion of the flexible locking piece 3 has a locking protrusion 3*b* for engaging the terminal. Each of the terminal accommodating chambers 1 has a bottom wall 4, the front end portion of which has a recess 4*a* into which a double-locking flexible locking piece (described below) is inserted.

Each of the terminal accommodating chambers 1 has four stoppers 5 at the front end which are arranged symmetrical, two on the right side and two on the left side, against which the metal terminal abuts when it is inserted into the chamber 1. The front surfaces of the stoppers 5 are sloped as indicated at 5*a*, merging with a terminal inserting hole 6 provided for receiving the mating male terminal (not shown); that is, the stoppers 5 each include tapered guide surfaces 5*a*.

Above the terminal inserting hole 6 is formed a jig inserting hole 7 in such a manner that it merges with the terminal inserting hole 6 and is confronted with the aforementioned space S.

A pair of guide ribs 8 and 8 are formed in the opposite side walls and merge with the aforementioned recess 4*a*, in such a manner that the guide ribs 8 extend in the front-to-rear direction. A pair of locking portions 9 protrude upwardly from the front ends of the guide ribs 8, respectively. The inner ends of the guide ribs 8 are sloped downwardly, forming flanks 8*a*.

The front holder B includes a plate-shaped holder body 10 which has terminal penetration holes 11 for receiving the mating male metal terminals in association with the above-described terminal inserting holes 6, and jig penetration holes 12 in association with the above-described jig inserting holes 7. The plate-shaped holder body 10 has double-locking flexible locking pieces 13 disposed below the terminal penetration holes 11 and extending from the inner surface of the plate-shaped holder body 10 towards the recesses 4 of the connector housing. Each of the double-locking flexible locking pieces 13 includes vertically extending terminal locking protrusion 13*a* and horizontally extending temporary locking protrusions 13*b* at the free end thereof, and horizontally extending final locking protrusions 13*c* at the mid-portion. Each of the temporary locking pieces 13*b* has a tapered engaging surface 13*b* which is sloped obliquely in the rearward direction as viewed in the direction of insertion. In each of the final locking pieces 13, as viewed in the direction of insertion, the front surface is formed into a tapered engaging guide surface $\mathbf{13}c_1$, and the rear surface is formed into a tapered engaging/disengaging guide surface $\mathbf{13}c_2$. Furthermore, the lower and upper surfaces of the final locking piece 13*c* are formed into a terminal disengaging tapered guide surface $\mathbf{13}c_3$, and a returning tapered guide surfaces $\mathbf{13}c_4$, respectively.

The female metal terminal C includes a female electrical contact portion $C_1$, and a wire connecting portion $C_2$. The female electrical contact portion $C_1$ has an engaging shoulder 14 which is engageable by the flexible locking piece 3, and a locking hole 15 which is engageable by the double-locking flexible locking piece 13.

The connector thus constructed functions as follows.

Figure 4:
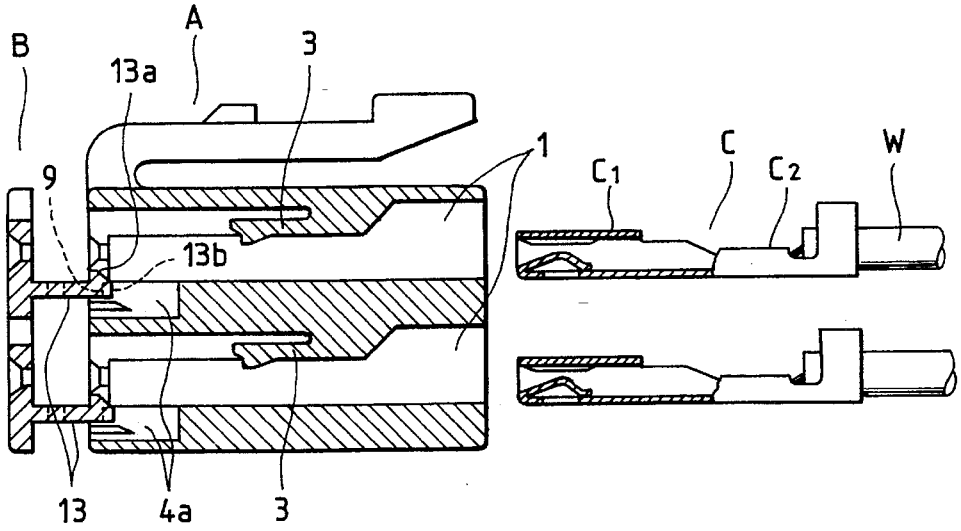
FIG. 4 is a sectional view showing the front holder which is temporarily locked to the connector housing.

When the rear holder is connected to the housing, the temporary locking protrusions 13*b* of the double-locking flexible locking pieces 13 of the front holder B, are pushed such that the tapered locking guide surfaces $\mathbf{13}b_1$ are urged against the locking portions 9, and slide over the latter 9, so that the temporary locking protrusions 13*b* are engaged with the locking portions 9 protruding from the guide ribs 8. Thus, the front holder B is temporarily fastened to the connector housing A (cf. FIG. 4).

Figure 5:
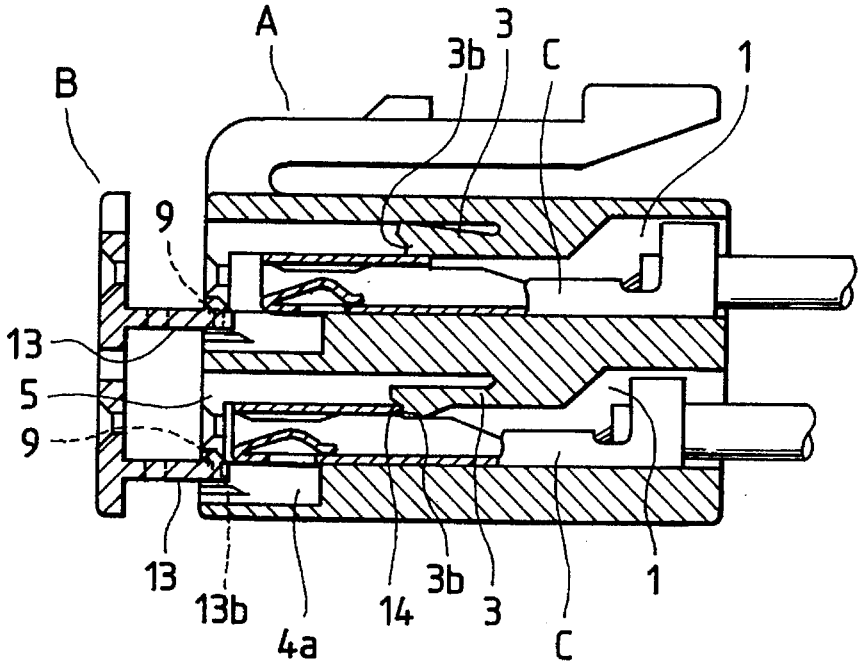
FIG. 5 is a sectional view showing the double locking connector in which the metal terminals are inserted into the connector housing to which the front holder has been temporarily locked.

Under this condition (in which the front holder B is temporarily fastened to the connector housing A), the metal terminals C, to which the electric wires W are connected, are inserted into the terminal accommodating chambers 1 in the connector housing A from the rear while displacing the flexible locking pieces 3 upwardly. When the front end of each metal terminal abuts against the stoppers 5, that is, when the metal terminal has been completely inserted into the terminal accommodating chamber, the flexible locking piece 3 is restored so that the locking protrusion 3*b* engages the engaging shoulder 14 of the metal terminal C. Thus, the metal terminal C is temporarily locked by the flexible locking piece 3 (cf. the lower half of FIG. 5). In the case where the metal terminal C is not properly positioned in the terminal accommodating chamber, i.e., not abutting against the stoppers 5, the flexible locking piece 3 remains in the deflected position thus being unable to lock the metal terminal C (cf. the upper half of FIG. 5).

With the metal terminals C inserted into the terminal accommodating chambers, the front holder B is pushed against the connector housing A. As a result, the final locking protrusions 13*c* of the double-locking flexible locking pieces 13 are moved toward the housing such that the tapered guide surfaces $\mathbf{13}c_1$ slide past the locking portions 9 and become engaged therewith. Thus, the front holder B is completely locked to the connector housing A (cf. FIG. 7). In this operation, the tapered abutting surface $\mathbf{13}a_1$ of each of the locking protrusions 13*a* abuts against the lower surface of the front end portion of the metal terminal C, so that the double-locking flexible locking piece 13 is downwardly deflected (cf. the lower half of FIG. 6). When the locking protrusion 13*a* reaches the locking hole 15, the double-locking flexible locking piece 13 is restored such that the locking protrusion 13*a* engages the locking hole 15 to secondarily lock the metal terminal C (cf. the lower half of FIG. 7).

Figure 6:
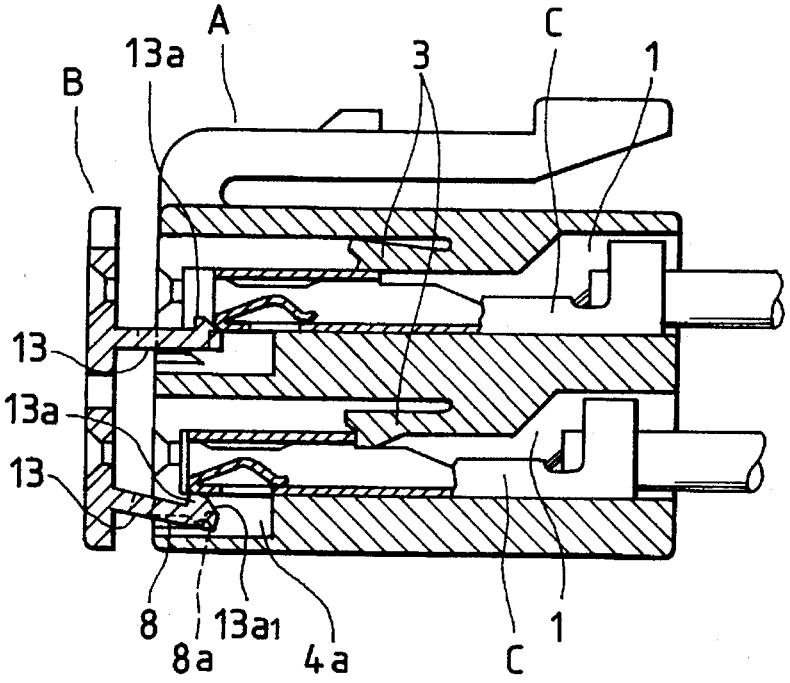
FIG. 6 is a sectional view of the double locking connector in which the front holder is being completely locked to the connector housing.
Figure 7:
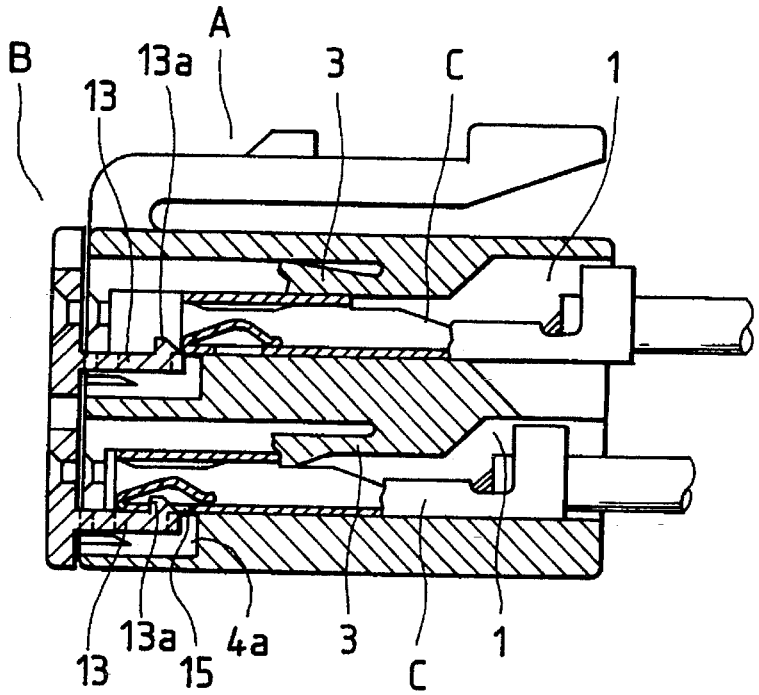
FIG. 7 is a sectional view of the double locking connector in which the front holder has been completely locked to the connector housing.

The tapered flanks 8*a* formed on the inner ends of the guide ribs 8 permit the displacement of the double-locking flexible locking piece 13 (cf. the lower half of FIG. 6). In the case where the metal terminal C is incompletely inserted into the terminal accommodating chamber, the terminal is pushed rearwardly by the locking protrusion 13*a* (cf. the upper half of FIG. 6). As a result, although the front holder B is completely locked, the wire connecting portion $C_2$ of the metal terminal C is exposed outside the housing. Hence, the fact that the terminal is not fully received in the terminal accommodating chamber can be visually detected (cf. the upper half of FIG. 7).

Figure 8:
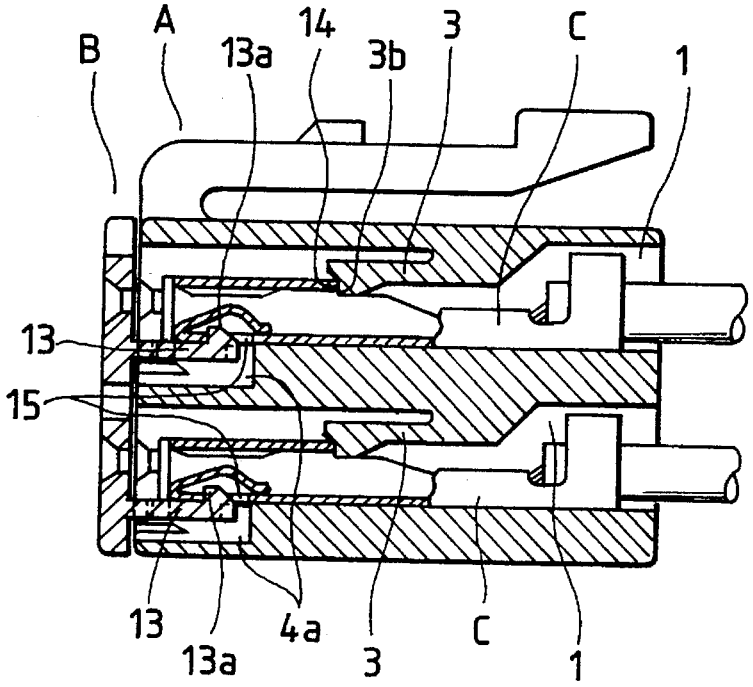
FIG. 8 is a sectional view of the double locking connector in which the front holder is in the finally locked position.
Figure 9:
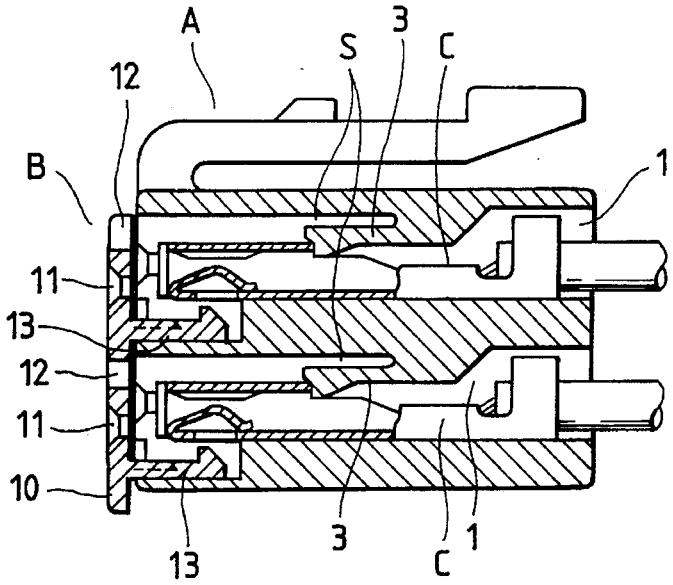
FIG. 9 is a sectional view of the double locking connector in which the front holder is displaced from its final locking position.

The metal terminals C are removed from the connector as follows. Under the condition that, as shown in FIG. 8, all the components are satisfactorily engaged with one another, the plate-shaped holder body 10 of the front holder B is pushed downwardly, so that the final locking protrusions 13*c* slide over the guide ribs 8 with the aid of the terminal disengaging tapered guide surfaces $\mathbf{13}c_3$. As a result, the front holder B is moved downwardly causing the locking protrusions 13*a* of the double-locking flexible locking pieces 13 to become disengaged from the locking holes 15 of the metal terminals C (cf. FIG. 9). Under this condition, the jig penetration holes 12 formed in the plate-shaped holder body 10 of the front holder B are aligned with the jig inserting holes 7 and with the spaces S defined by the flexible locking pieces 3, respectively. Hence, the metal terminal C can be removed from the connector as follows. A disengaging jig (not shown) is inserted into the respective jig penetration holes 12 to disengage the flexible locking piece 3 from the metal terminal C, thereby to remove the latter C from the connector housing.

When the holder body 10 of the front holder B is pushed upwardly, the final locking protrusions 13*c* are moved over the guide ribs 8 with the aid of the returning tapered guide surfaces $\mathbf{13}c_4$, thus being returned to lock the metal terminals C with in the housing.

Figure 10:
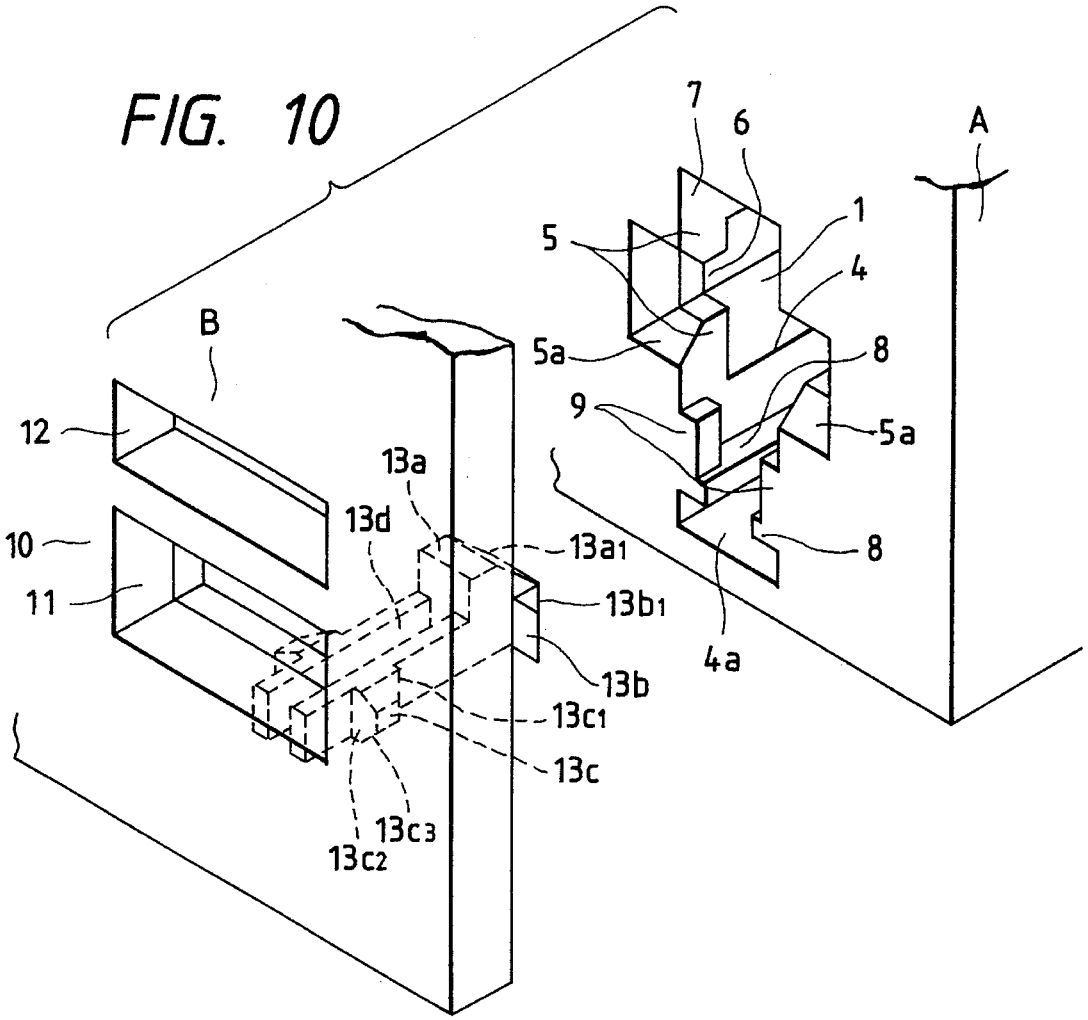
FIG. 10 is a perspective view showing essential components of a second embodiment of the invention.
Figure 11:
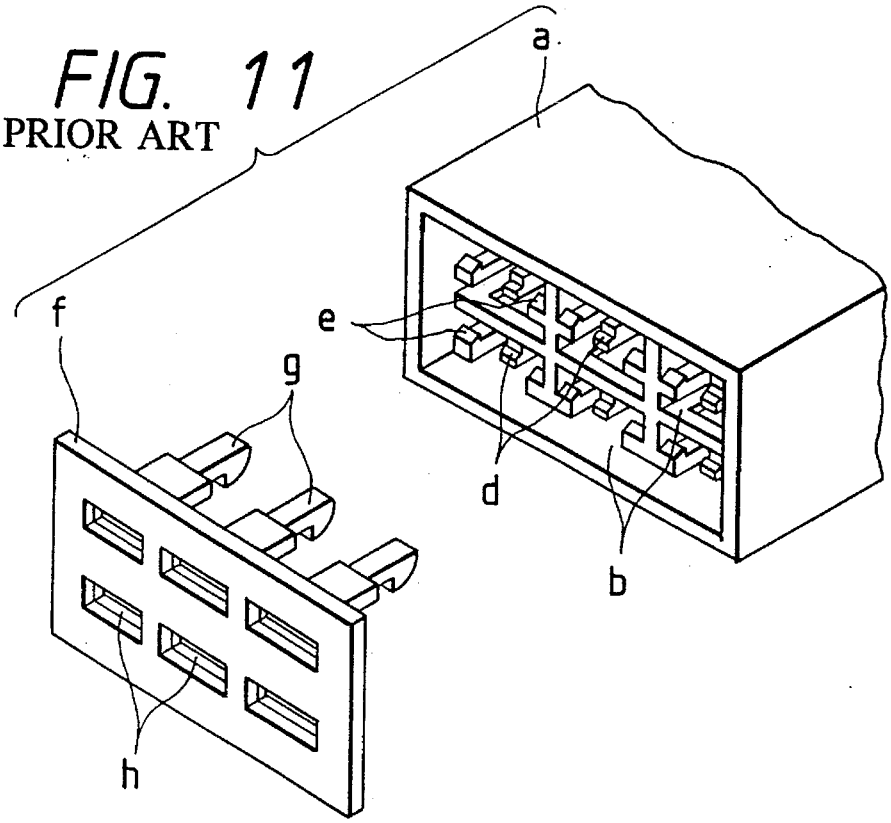
FIG. 11 PRIOR ART
FIG. 11 is a perspective view of a conventional front-holder-covered double locking connector, showing a connector housing, and a front holder disengaged from the latter.
Figure 12:
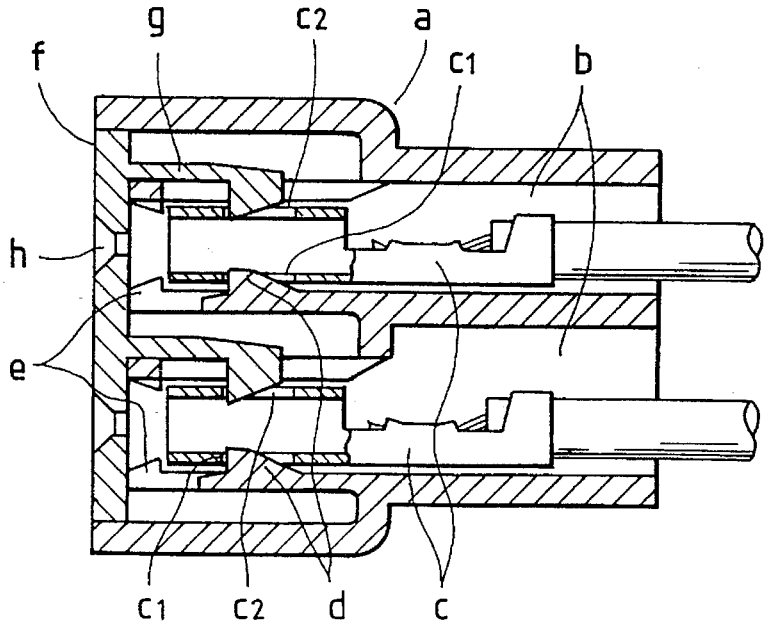
FIG. 12 PRIOR ART
FIG. 12 is a sectional view of the conventional double locking connector, showing the connector housing, and the front holder engaged with the latter.

FIG. 10 shows a second embodiment of the invention. In the second embodiment, each of the double-locking flexible locking pieces 13 of the front holder B has a slit 13*d* extending longitudinally, so that, when the final locking protrusions 13*c* and 13*c* are compressed inwardly, the double-locking flexible locking piece 13 is allowed to move backwardly. That is, the provision of the slits 13*d* makes it easier for the final locking protrusions 13*c* to be inserted into the terminal accommodating chamber 1 past the locking portions 9 and in engagement therewith.

The double-locking connector according to the present invention has the following effects or merits. With the front holder temporarily engaged with the connector housing, the metal terminals are inserted into the terminal accommodating chambers. Under this condition, the front holder is pushed against the connector housing to be completely engaged with the latter, so that the metal terminals are double-locked with ease. Additionally, the metal terminals thus double-locked can be readily unlocked without removal of the front holder.

Another advantage of the double-locking connector is that if any one of the metal terminals is not in place in the terminal accommodating chamber (not being completely inserted in the chamber), the terminal is pushed rearwardly when the front holder is moved so as to be completely engaged with the connector housing. Hence, it can be readily detected whether or not the metal terminals have been correctly positioned in the terminal accommodating chambers.

Furthermore, when the metal terminals have been double-locked, the front openings of the terminal accommodating chambers are closed by the front holder. Hence, the double-locking connector is free from the difficulties that the primary locking members, namely, the flexible locking pieces of the connector housing, are meaninglessly operated with the terminal removing jig, and the metal terminals are damaged from being forcibly handled.

What is claimed is:

1. A double-locking connector, comprising:

a connector housing having terminal accommodating chambers for receiving metal terminals, said housing including stoppers provided in said chambers against which metal terminals abut when said terminals are inserted into said terminal accommodating chambers from a rearward end, and flexible locking pieces extending into said chambers for retaining said metal terminals in said terminal accommodating chambers, respectively; and a front holder engageable with a forward end of said connector housing by moving said front holder in a longitudinal direction of said connector housing, said front holder having double-locking flexible locking pieces which are engageable with said metal terminals, respectively, each of said double-locking flexible locking pieces having temporary locking protrusions and final locking protrusions which are engageable with locking portions formed in the forward end of the respective terminal accommodating chambers by moving said front holder in said longitudinal direction from a temporarily locked position to a completely locked position, wherein when said front holder is in said temporarily locked position, said double-locking flexible locking pieces are located at non-engagement positions where said double-locking flexible locking pieces are not engaged with said metal terminals, when said front holder is in said completely locked position, said double-locking flexible locking pieces are located at engagement positions where said double-locking flexible locking pieces are engaged with said metal terminals, and when said front holder thus completely locked is moved in a direction perpendicular to the longitudinal direction, said final locking protrusions are moved to positions where said final locking protrusions are not engaged with said metal terminals.

2. A double-locking connector as claimed in claim 1, wherein each of said double-locking flexible locking pieces includes a locking protrusion having a tapered abutting surface which is abutted against the front end portion of an associated metal terminal such that said metal terminal is urged toward said rearward end when said front holder is moved to said completely locked position and said metal terminal is not completely inserted in an associated terminal accommodating chamber.

3. A double-locking connector, comprising:

a connector housing having terminal accommodating chambers for receiving metal terminals, said housing including stoppers provided in said chambers against which metal terminals abut when said terminals are inserted into said terminal accommodating chambers from a rearward end, and flexible locking pieces extending into said chambers for retaining said metal terminals in said terminal accommodating chambers, respectively; and a front holder engageable with a forward end of said connector housing by moving said front holder in a longitudinal direction of said connector housing, said front holder having double-locking flexible locking pieces which are engageable with said metal terminals, respectively, each of said double-locking flexible locking pieces having temporary locking protrusions and final locking protrusions which are engageable with locking portions formed in the forward end of the respective terminal accommodating chambers, wherein when said front holder is temporarily locked to said connector housing, said double-locking flexible locking pieces are located at non-engagement positions where said double-locking flexible locking pieces are not engaged with said metal terminals, when said front holder is completely locked to said connector housing, said double-locking flexible locking pieces are located at engagement positions where said double-locking flexible locking pieces are engaged with said metal terminals, and when said front holder thus completely locked is moved in a direction perpendicular to the longitudinal direction, said final locking protrusions are moved to positions where said final locking protrusions are not engaged with said metal terminals, wherein said front holder includes a plate-shape holder body having jig penetration holes, and wherein when said front holder is moved in said perpendicular direction to a non-engagement position, said jig penetration holes communicate with jig inserting holes formed in said connector housing.

4. A connector, comprising:

a housing having a forward end and a rear end and at least one terminal accommodating chamber extending in a longitudinal direction of said housing for receiving a metal terminal which is insertable from said rear end, said forward end having an opening therein; and a front holder engageable with said forward end of said housing, said front holder including at least one flexible locking piece extending therefrom and being insertable into said opening, said locking piece including (1) a temporary locking protrusion for engaging a locking portion of said housing to lock said holder in said housing in a temporary locked position at which the terminal can be inserted into said chamber, (2) a final locking protrusion for engaging said locking portion to lock said holder in a finally locked position and (3) a terminal locking protrusion for engaging and locking said terminal in said chamber when said holder is in said finally locked position, wherein said holder is moveable from said temporary locked position to said finally locked position by moving said front holder in said longitudinal direction toward said housing, and said holder is moveable from said finally locked position to a terminal disengaging position in a direction perpendicular to said longitudinal direction to thereby disengage said terminal locking protrusion from said terminal to allow removal thereof.

5. The connector of claim 4, wherein said housing includes a plurality of said chambers and said front holder includes an associated plurality of said flexible locking pieces.

6. The connector of claim 4, wherein said terminal locking protrusion has a tapered surface which abuts against said terminal when said front holder is moved from said temporary locked position to said final locked position to cause said locking protrusion to deflect.

7. The connector of claim 4, wherein said housing includes a flexible engagement member extending into said chamber for engaging and locking said terminal therein.

8. The connector of claim 4, wherein said temporary locking protrusion is chamfered to facilitate insertion thereof past said locking portion and into said opening.

9. The connector of claim 4, wherein said final locking protrusion is chamfered to facilitate insertion thereof past said locking portion and into said opening.

10. The connector of claim 4, wherein said final locking protrusion extends perpendicular to said terminal locking protrusion.

11. The connector of claim 4, wherein said flexible locking piece includes a pair of each of said final locking protrusion and said temporary locking protrusion extending in opposite directions.

12. A connector, comprising:

a housing having a forward end and a rear end and at least one terminal accommodating chamber extending in a longitudinal direction of said housing for receiving a metal terminal which is insertable from said rear end, said forward end having an opening therein; and a front holder engageable with said forward end of said housing, said front holder including at least one flexible locking piece extending therefrom and being insertable into said opening, said locking piece including (1) a temporary locking protrusion for engaging a locking portion of said housing to lock said holder in said housing in a temporary locked position at which the terminal can be inserted into said chamber, (2) a final locking protrusion for engaging said locking portion to lock said holder in a finally locked position and (3) a terminal locking protrusion for engaging and locking said terminal in said chamber when said holder is in said finally locked position, wherein said holder is moveable from said finally locked position to a terminal disengaging position in a direction perpendicular to said longitudinal direction to thereby disengage said terminal locking protrusion from said terminal to allow removal thereof, wherein said housing includes a flexible engagement member extending into said chamber for engaging and locking said terminal therein, and wherein said front holder has a jig receiving hole adapted to receive a jig to disengage said engagement member from said terminal when said front holder is in said disengaging position.

13. A connector, comprising:

a housing having a forward end and a rear end and at least one terminal accommodating chamber extending in a longitudinal direction of said housing for receiving a metal terminal which is insertable from said rear end, said forward end having an opening therein; and a front holder engageable with said forward end of said housing, said front holder including at least one flexible locking piece extending therefrom and being insertable into said opening, said locking piece including (1) a temporary locking protrusion for engaging a locking portion of said housing to lock said holder in said housing in a temporary locked position at which the terminal can be inserted into said chamber, (2) a final locking protrusion for engaging said locking portion to lock said holder in a finally locked position and (3) a terminal locking protrusion for engaging and locking said terminal in said chamber when said holder is in said finally locked position, wherein said holder is moveable from said finally locked position to a terminal disengaging position in a direction perpendicular to said longitudinal direction to thereby disengage said terminal locking protrusion from said terminal to allow removal thereof, wherein said housing includes a pair of longitudinally extending guide ribs protruding from opposite side walls of said chamber, said final locking protrusion passing over one of said guide ribs when moving from said finally locked position to said disengaging position.

14. A connector comprising:

a housing having a forward end and a rear end and at least one terminal accommodating chamber extending in a longitudinal direction of said housing for receiving a metal terminal which is insertable from said rear end, said forward end having an opening therein; and a front holder engageable with said forward end of said housing, said front holder including at least one flexible locking piece extending therefrom and being insertable into said opening, said locking piece including (1) a temporary locking protrusion for engaging a locking portion of said housing to lock said holder in said housing in a temporary locked position at which the terminal can be inserted into said chamber, (2) a final locking protrusion for engaging said locking portion to lock said holder in a finally locked position and (3) a terminal locking protrusion for engaging and locking said terminal in said chamber when said holder is in said finally locked position, wherein said holder is moveable from said finally locked position to a terminal disengaging position in a direction perpendicular to said longitudinal direction to thereby disengage said terminal locking protrusion from said terminal to allow removal thereof, wherein said flexible locking piece includes a pair of each of said final locking protrusion and said temporary locking protrusions extending in opposite direction, and wherein said flexible locking piece has a slit extending longitudinally therein to allow said final locking protrusions to deflect toward each other when said front holder is moved from said temporary locked position to said finally locked position.

* * * * *